United States Patent [19]

Konopko

[11] 4,372,446

[45] Feb. 8, 1983

[54] SELF-LOCKING PROTECTIVE PADS AND BLANK THEREFOR

[75] Inventor: Matthew S. Konopko, Oak Lawn, Ill.

[73] Assignee: Stone Container Corp., Chicago, Ill.

[21] Appl. No.: 262,193

[22] Filed: May 11, 1981

[51] Int. Cl.[3] ..... B65D 81/02

[52] U.S. Cl. ..... 206/586; 229/1.5 R; 229/DIG. 1

[58] Field of Search ..... 229/DIG. 1, 16 R, 1.5 R; 206/586, 521; 248/345.1

[56] References Cited

U.S. PATENT DOCUMENTS

| | | | |
|---|---|---|---|
| 2,514,833 | 7/1950 | Bergeron | 229/1.5 R |
| 3,063,613 | 11/1962 | McClive | 229/DIG. 1 |
| 3,655,112 | 4/1972 | Jeffers | 229/DIG. 1 |
| 3,843,038 | 10/1974 | Sax | 229/DIG. 1 |
| 3,900,156 | 8/1975 | Clark, Jr. | 229/DIG. 1 |

*Primary Examiner*—William Price
*Assistant Examiner*—Gary E. Elkins
*Attorney, Agent, or Firm*—Silverman, Cass & Singer, Ltd.

[57] ABSTRACT

A pad for protection of crated objects, such as appliances, furniture or the like is formed from an integral blank of corrugated paperboard. In one embodiment, a corner pad can be formed having multiple-ply walls and a multiple-ply base including two leg formations joined to form an L-shaped structure in which one of the leg formations includes a wedge or tongue which is inserted between adjacent plies of the second leg formation to achieve self-locking of the corner pad.

In a second embodiment, the same blank can be assembled into an edge protective pad.

9 Claims, 9 Drawing Figures

FIG. 2
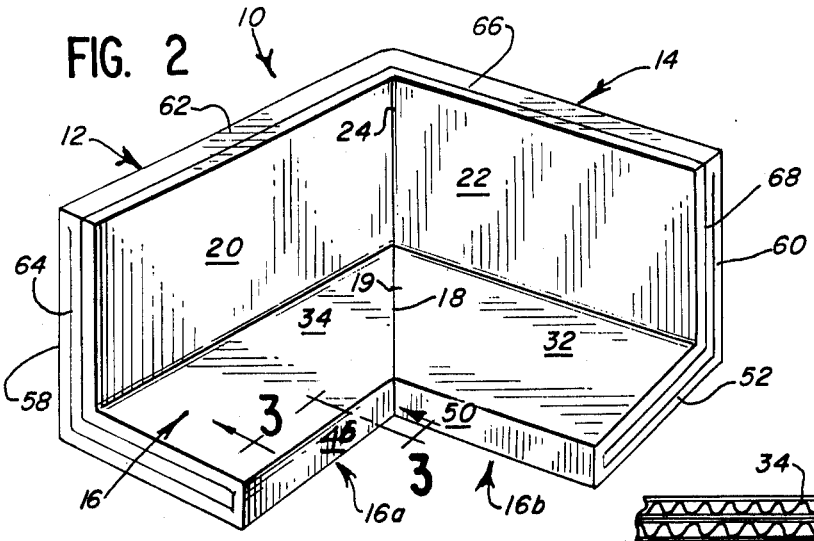
FIG. 3
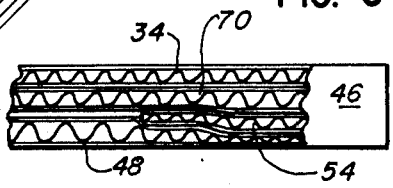
FIG. 6
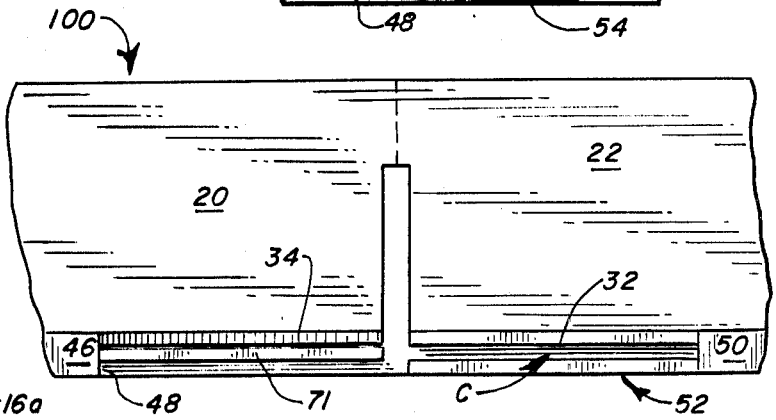
FIG. 4
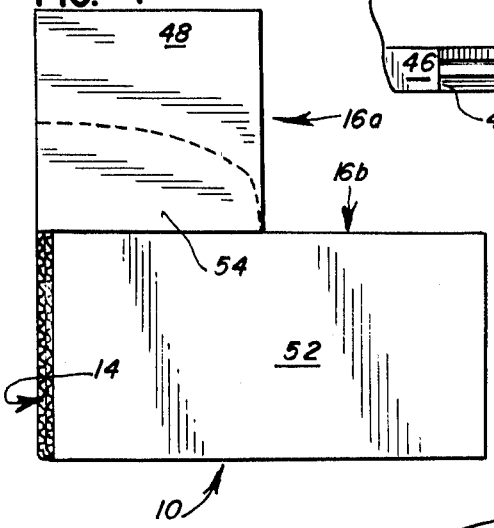
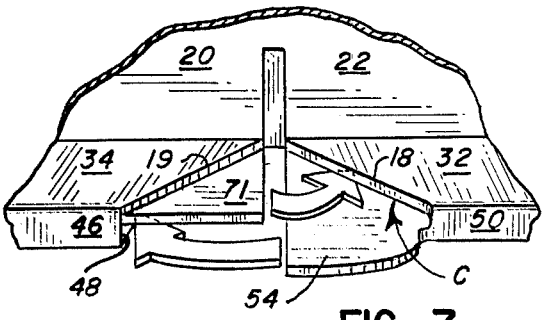
FIG. 7
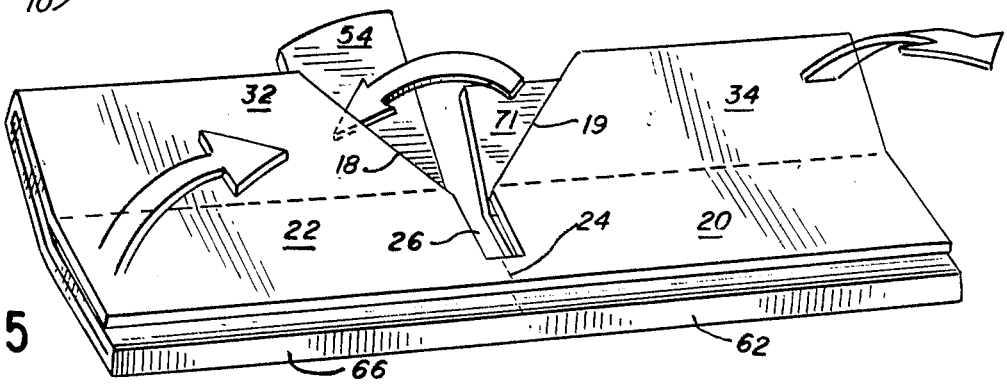
FIG. 5

FIG. 8
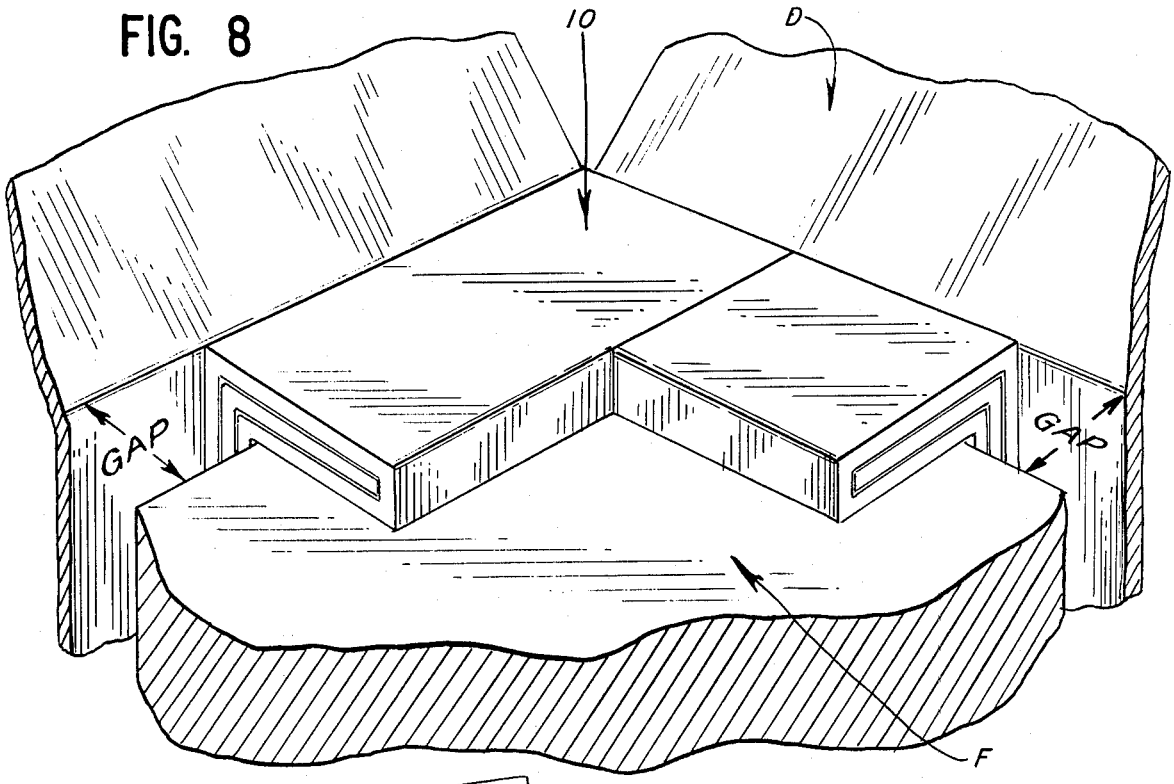
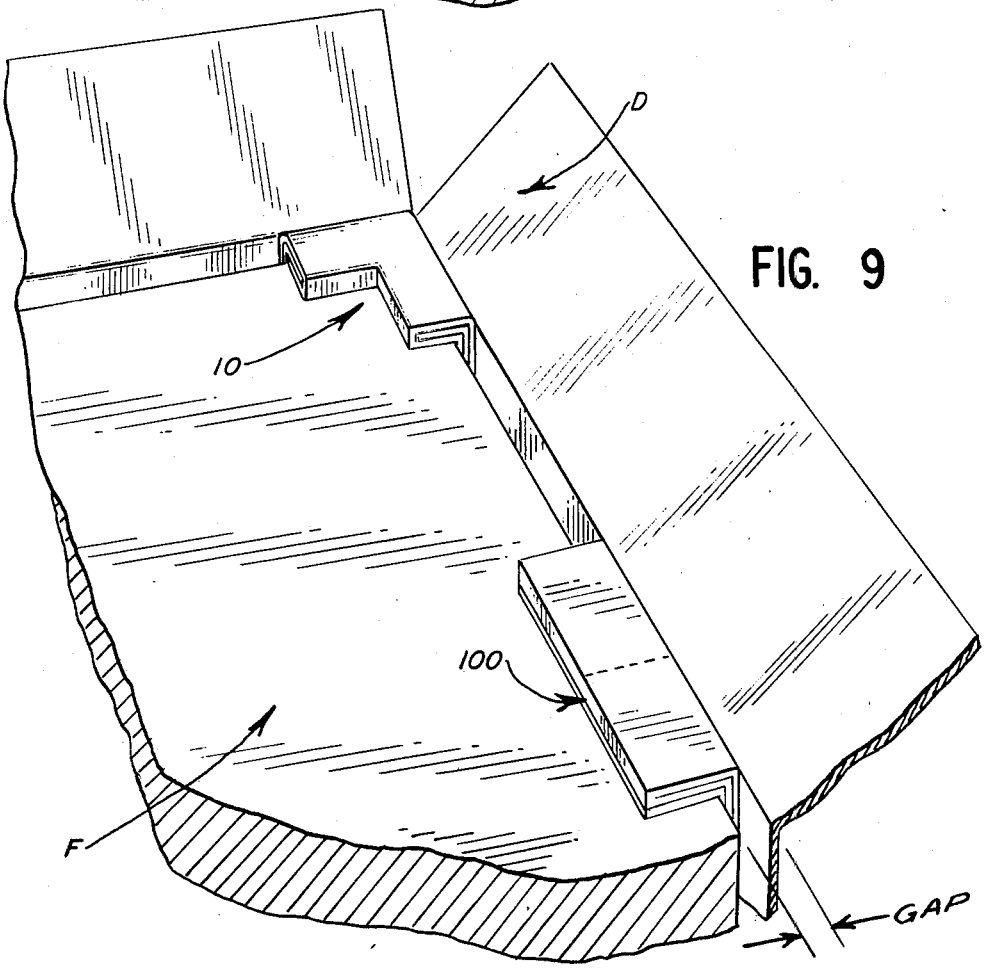
FIG. 9

SELF-LOCKING PROTECTIVE PADS AND BLANK THEREFOR

BACKGROUND OF THE INVENTION

This invention generally relates to protective corner and edge pads for crated objects, such as appliances, furniture or the like. More particularly, this invention relates to improved protective pads formed from corrugated paperboard with novel self-locking feature when assembled.

Shipment of furniture, appliances and other objects in conventional shipping crates or cartons often requires protective pads at the corners of such containers, and sometimes, at other locations, in order both to protect the object and to reduce or prevent shifting of the object in the carton during shipment. Protective pads have been developed using integral corrugated paperboard blanks designed to be folded into useful configurations for protective pad utilization.

Corrugated paperboard blanks capable of being formed into protective pads are widely used and enjoy substantial commercial preference. For example, U.S. Pat. No. 2,509,468 describes a corrugated paperboard corner pad assembled from a blank by folding to provide a rectangular base having four thicknesses, and vertical, triangular sides at right angles likewise having four thicknesses; each triangular side is provided with a notch and tongue to secure the folded corner configuration. Similarly, U.S. Pat. No. 3,843,038 describes a corner pad assembled from a corrugated paperboard sheet folded so that a three wall configuration of multiple-ply walls has one of the walls provided with locking tabs to secure the folded configuration. U.S. Pat. No. 3,655,112 describes a corner pad in which a sheet of corrugated paperboard is folded into generally double-paneled walls in which sections of a base are joined at mitered edges including a tongue and a notch respectively formed to lock the folded configuration.

The prior art devices identified have not been satisfactory for several cogent reasons. Generally, these have utilized complex configurations of panels which unduly complicated assembly thereof. Another deficiency has been lack of suitable thickness for the pad so that desirable pad protection could be achieved, especially for large, bulky and heavy objects or objects such as furniture made of wood which was easily damaged in shipment. Finally, the lacking of the pad assembly after folding was not sufficiently reliable.

Another deficiency of prior art structures was the failure to provide a single foldable blank which could be assembled, selectively, either as a corner pad or an edge pad with equally desirable results.

SUMMARY OF THE INVENTION

According to this invention, a protective pad for a crated object, such as an appliance, furniture or similar cargo has a corner configuration of multiple-ply walls including a reliable, self-locking base structure. The base structure comprises a generally L-shaped configuration provided by two leg members which are joined so that a wedge member projects from one of the leg members into the other leg member between its adjacent plies to provide frictional self-locking into the corner configuration of the pad.

In the preferred construction, the corner pad is erected from an integral blank of paperboard folded to provide triple-ply thickness for the walls and base thereat. Additionally, the base can be constructed so that one of the leg members has an intermediate-ply panel recessed to create a cavity between the interior and exterior plies. The cavity is arranged to receive a projecting tenon member formed on the intermediate-ply of the other leg member to form a frictionally engaged bridge between the leg members which reinforces the self-locking corner configuration of the pad.

Further the same paperboard blank for the corner pad also can be folded to provide an edge pad. This edge pad is formed by incomplete erection of the same blank from which the corner pad is assembled. Notably, the edge pad can be installed selectively to provide cushioning for two generally right angular surfaces.

BRIEF DESCRIPTION OF THE DRAWING

FIG. 2 is a perspective view of a corner pad assembled according to the invention from the blank shown in FIG. 1;

FIG. 3 is a sectional view taken along lines 3—3 in FIG. 2, showing the locking wedge formation in the base structure of the corner pad;

FIG. 4 is a bottom plan view of the erected corner pad of FIG. 2, showing the locking wedge formation in hidden line;

FIG. 5 is a perspective view of the corner pad illustrated partially folded toward the completed pad shown in FIG. 2;

FIG. 6 is a partial elevational view of the edge protective pad shown in FIG. 9, which can be further folded to complete the erection of the corner pad in FIG. 2;

FIG. 7 is a fragmentary perspective view of the corner protective pad with illustrative arrows for folding;

FIG. 8 is a fragmentary, perspective view of the corner pad shown in FIG. 2 in position upon an object at the corner of the shipping crate; and FIG. 9 is a fragmentary, perspective view of the corner pad placement shown in FIG. 8, and further showing the edge protective configuration of the pad shown in FIG. 5, placed in cushioning position upon a length of the edge of the crated object.

DESCRIPTION OF THE PREFERRED EMBODIMENT

Figure 1:
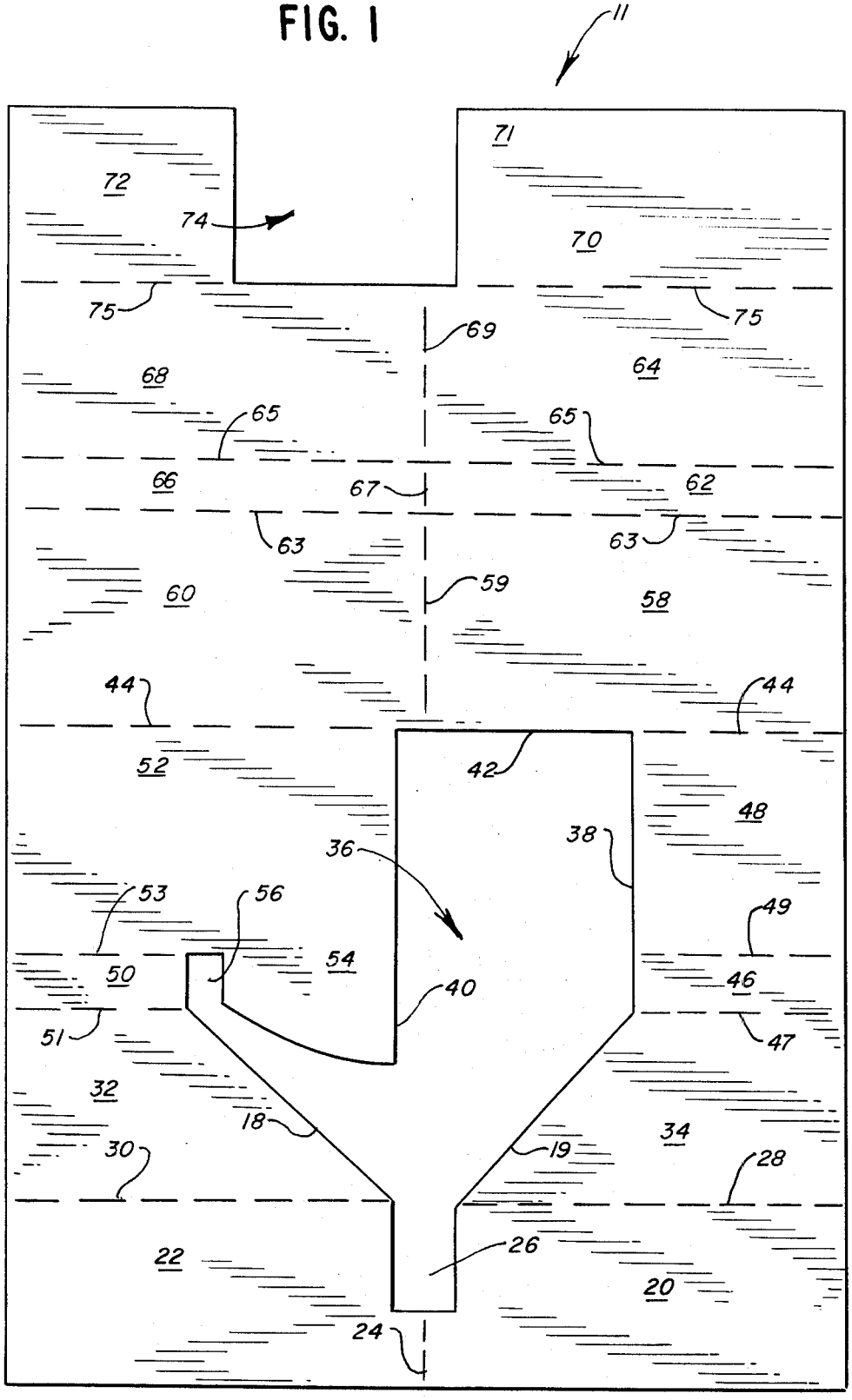
FIG. 1 is a plan view of a single-piece blank formed in accordance with this invention.

Referring to FIG. 2, a protective corner pad according to the invention, is designated generally by the reference character 10. Corner pad 10 includes two, multiple-ply, vertical wall members 12 and 14 which form a substantially right angle; each of wall members 12 and 14 is joined at substantially right angle to multiple-ply base member 16 as further shown in FIG. 2. Base 16 is generally L-shaped in configuration to include legs **16*a* and 16*b*. As shown in FIGS. 2 and 5, legs 16*a* and 16*b* are joined at mitered edges 18 and 19, preferably at substantially 45 degrees, to produce the L-shaped configuration of base 16**.

Corner pad 10 is erected from a single-piece blank 11 shown in FIG. 1. The sheet material for blank 11 can be any suitably rigid but foldable material. Preferably, blank 11 is stamped or die cut from a web of corrugated or solid-fiber paperboard which can be folded into the self-locking configuration of corner pad 10, as more fully described hereinafter.

Referring to FIG. 1, blank 11 is a generally rectangular sheet of corrugated paperboard with both layers of fluting oriented generally parallel to the longer dimension of the rectangular sheet. Blank 11 is designed to enable both vertical walls 12 and 14 and base to form triple-thickness for the erected corner pad 10. However, additional panels can be provided in a blank similar to blank 11 in order to produce a corner pad having four-ply or greater thickness.

As seen in FIG. 1, at one end of blank 11 interior wall panels 20 and 22 are substantially aligned and integrally hinged endwise by score or fold line 24. Preferably, a narrow cutout 26 between interior wall panels 20 and 22 is aligned with score line 24 to facilitate their folding at a right angle to form the interior walls of vertical walls 12 and 14, respective, in the erected corner pad 10.

Panels 20 and 22 are integrally hinged by respective score lines 28 and 30 to respective interior base panels 32 and 34. Panels 32 and 34 are mitered preferably 45 degrees at respective opposing edges 18 and 19 positioned in generally mirror-image alignment. Panels 32 and 34 are foldable to form the mitered interior walls of legs 16*b* and 16*a*, respectively, in the erected corner pad 10.

Mitered edges 18 and 19 are formed as cut lines which partially define cutout 36 extending inwardly along generally parallel cut lines 38 and 40. Cut lines 38 and 40 intersect terminal cut line 42 which is in alignment and interrupts score line 44 which generally bisects the length of blank 11.

As shown in FIG. 1, panel 46 is integrally hinged to interior base panel 34 and external base panel 48 by respective score lines 47 and 49 positioned on opposite edges of hinge panel 46. Panel 46 facilitates folding of exterior base panel 48 through 180 degrees in order to underlie interior base panel 34 to form leg 16*a* of base structure 16 in the erected corner pad 10. Similarly, panel 50 is integrally hinged to interior base panel 32 and exterior base panel 52 by respective score lines 51 and 52. Thus, exterior base panel 52 is folded 180 degrees to underlie interior base panel 32 to form leg 16*b* of base 16 in the erected corner pad 10.

In contrast to exterior base panel 48, exterior base panel 52 is somewhat larger and preferably has an integral projection 54 extending toward cut line 18. Projection 54 is defined between cut line 40 and notch 56 which also defines the interior end of hinge panel 50. As shown in FIG. 3, projection 54 provides a frictionally-locking wedge or tongue between adjacent panels 48 and 70 of leg 16*a* for erection of corner pad 10. Wedge 54 is shown in hidden line beneath exterior base panel 48 in FIG. 4.

Referring again to FIG. 1, exterior base panel 48 is integrally hinged by score line 44 to exterior wall panel 58 which is integrally hinged endwise by score line 59 to exterior wall panel 60. Panels 58 and 60 form the outside walls of vertical walls 14 and 12, respectively, in the erected corner pad 10.

Narrow pad 62 is integrally hinged to exterior wall panel 58 and intermediate wall panel 64 by respective score lines 63 and 65 formed on opposite edges of hinge panel 62. Hinge panel 62 is hinged endwise to hinge panel 66 along score line 67. Intermediate wall panel 64 is hinged endwise to intermediate wall panel 68 along score line 69. Intermediate wall panels 64 and 68 are folded to form respective intermediate walls in face-to-face contact between the exterior and interior wall panels of vertical walls 12 and 14.

Intermediate base panels 70 and 72 are formed at the opposite end of blank 11 from panels 20 and 22. Panels 70 and 72 are separated endwise by a rectilinear cutout 74, and are hinged to intermediate wall panels 64 and 68, respectively, by score line 75. Cutout 74 is dimensioned so that the length of cut line 76, being the distance between the opposing edges of panels 70 and 72 defined by respective cut lines 78 and 77, is at least as long as, and preferably equal to, cut lines 76 and 80. This enables coplanar, right angular abutment of panels 70 and 72 upon their relative rotation in the erected corner pad 10, as described hereinafter. Preferably, cutout 74 is positioned offset from the centrally aligned score line 69 so that panel 70 is larger than panel 72. This provides extended frictional bridging between legs 16*a* and 16*b* of base 16 in the erected corner pad 10.

When blank 11 is to be erected, panels 64, 68, 70, and 72 are folded 180°, as a unit, backward along score line 63 and inward along score line 65, until they lie in face-to-face contact beneath panels 58, 60, 48, and 52 respectively, thus positioning hinge panels 62 and 66 at substantially right angle to such face-engaged panel units. Similarly, thus face-engaged panels forming a two-ply unit can next be folded backward and inward until so that intermediate wall panel 64 is sandwiched in contact between exterior wall panel 58 and interior wall panel 20, with intermediate wall panel 68 similarly sandwiched in face-to-face contact between exterior wall panel 60 and interior wall panel 22. Thus folded, intermediate base panel 70 will now be sandwiched in face-to-face contact between exterior base panel 48 and interior base panel 34 with the corner 71 of intermediate base panel 70 projecting therebetween as a tenon member, as shown in FIGS. 5 and 7. This also creates a cavity C of generally slot-like configuration between exterior base panel 52 and interior base panel 32, created by removal of cutout 74, in the plane of recessed intermediate base panel 72, as shown in FIG. 6.

The folded configuration shown in FIG. 5 can now be folded along score lines 30 and 28 so that base leg 16*a* is positioned substantially at a right angle to wall 12. Base leg 16*b* is similarly positioned substantially at a right angle to wall 14 to form the configuration shown in FIG. 6. At this point, the configuration shown in FIG. 6 forms a very effective edge pad 100, without further folding. In this posture, pad 100 is usable along a single edge of a crated object, as shown in FIG. 9.

To complete assembly to corner pad 10 from the pad configuration 100 shown in FIG. 6, wall structures 12 and 14 are folded along score line 24 into substantially right angular relationship so that legs 16*a* and 16*b* of base 16 are also rotated into right angular configuration in the same general plane, with abutment of the mitered edges 18 and 19 on interior base panels 34 and 32, respectively, as shown in FIG. 2. Such right angular folding, as depicted by the arrows in FIGS. 5 and 7, results in the insertion of tenon corner 71 into the cavity C for frictional engagement between interior base panel 32 and exterior base panel 52 of base leg 16*b*. Such folding further results in the forced insertion of wedge 54 into frictional engagement between exterior base panel 48 and intermediate base panel 70, as best shown in FIG. 3, to complete self-locking of the fully erected corner pad 10.

Unlike reception of tenon-corner 71 in the generally coextensive cavity C, wedge 54 is forced between adjacent panels 48 and 70 so that the frictional securement of wedge 54 normally prevents its inadvertent withdrawal. However, wedge 54 can be deliberately withdrawn to disassemble the corner pad 10 or to convert it to use as an edge protective pad 100.

The width of hinge panel 46 can be slightly greater than the combined width of the multiple plies of leg 16*a*, in order to ease the wedging as shown in FIG. 3 and to prevent excessive bulging or distorsion in the erected corner pad 10 without elimination the frictional self-locking thereof.

FIGS. 8 and 9 illustrate use of corner pad 10 and the edge protective configuration 100 thereof. In FIG. 8, corner pad 10 is oriented similarly to the bottom view of FIG. 4, and positioned upon a wrapped article of furniture F, or the like, to be protectively cushioned at the corner of typical shipping container D. As shown in FIG. 8, corner pad 10 preferably engages both container D and wrapped object F to provide a cushioning gap or clearance therebetween at the three surfaces of the corner configuration. In addition, coatings can be applied to either or both of the surfaces of the blank to improve adhesion or modify abrasion by the erected corner pad 10. In the illustrated triple thickness, corner pad 10 can conveniently provide a typical clearance of approximately three-quarters inch or greater, governed by the gauge of the original blank employed.

Where protection along a linear edge of the object is desired, the pad shown in the configuration of FIGS. 6 and 7 can be employed, without further folding, to provide cushioning of two generally right angular surfaces as shown in FIG. 9. Pad 100 can also be employed in the right angular configuration inverted from that shown in FIG. 9. When used to erect such edge protective pad 100, blank 11 can be modified without removal of cutout formation 36, for example, by scoring an outline to prepare such removal.

Variations from the embodiments described and illustrated can be developed within the scope of the claimed invention. For example, when mitered edges on the interior base panels are to be avoided, blank 11 can be modified so that interior base panels 32 and 34 are formed in rectilinear configuration providing a cutout separating them, similar to cutout 74, to enable right angular abutment upon folding, in the manner provided for the unequal lengths of intermediate base panels 70 and 72. Preferably, in such modification, panel 32 can be formed as the longer of the two interior base panels, for example, by providing a cut line as an extension of score line 51, to intersect cut line 40, thus abbreviating the projection of wedge formation 54. Such abbreviation of wedge formation 54 can be compensated, if necessary, by adjusting the length of exterior base panel 48 to provide the required extent of wedging in the erected corner pad for securement of the frictional self-locking configuration. Thus, the relative dimensioning of wedge formation 54 and exterior base panel 48 is adjustable to enable sufficient frictional self-locking in any embodiment of the corner pad configuration in accordance with this invention.

I claim:

1. A pad for protection of a crated object, formed from a single blank of foldable sheet material, said pad comprising:

A. a pair of multiple-ply wall formations intersecting at an angle to form two walls of a corner configuration.

B. a multiple-ply base formation connected to both of said walls at substantially right angle in said corner configuration;

C. said base formation being of generally L-shaped configuration having conjoined first multiple-ply leg and second multiple-ply leg formations; and D. said first and second multiple-ply leg formations having an equal number of overlying plies, the plies of the first leg formation being in generally coplanar alignment with the corresponding plies of the second leg formation, one of the plies of the first leg formation including a projecting coplanar wedge slidably received between a pair of immediately adjacent plies of the second leg formation, one of which corresponds to the ply of the first leg formation from which the wedge projects, said pair of immediately adjacent plies releasably frictionally retaining said wedge against slidable withdrawal from therebetween.

2. The pad as claimed in claim 1, wherein each of said multiple-ply leg formations includes at least one intermediate base ply sandwiched in substantially face-to-face contact between an exterior base ply and an interior base ply to form said base formation into at least a three-ply thickness.

3. The pad as claimed in claim 2, wherein one of said leg formations has the intermediate base ply thereof recessed to form a cavity between said interior and exterior base plies; said cavity opening outward toward the other of said leg formations, the intermediate base ply of said other leg formation including an outwardly projecting tenon releasably introduced into said cavity through the cavity opening.

4. The pad as claimed in claim 2 or 3, wherein said wedge is formed on said exterior base ply of one of said leg formations.

5. The pad as claimed in claim 4, wherein said wedge projects from one of said leg formations and said tenon projects from said other leg formation.

6. The pad as claimed in claim 5, wherein one of the plies frictionally retaining said wedge comprises said intermediate base ply having said tenon formed thereon.

7. A foldable, generally rectangular blank of paperboard material or the like having a plurality of hingedly connected panels for erecting a protective pad in a generally corner configuration, comprising:

A. at least two panel groups, connected together along a longitudinal fold line extending longitudinally therebetween, each of said panel groups including a plurality of wall panels and a plurality of base panels connected by transverse fold lines extending transversely of said panel groups and the longitudinal fold line therebetween, each of said wall panels and base panels in each of said panel groups being aligned generally endwise with a corresponding panel in the other panel group;

B. one of said base panels in one of said panel groups having a wedge formation projecting from said base panel, said wedge formation being at least partially defined by at least a first cutline oriented generally parallel to said longitudinal fold line, said cutline further partially defining a cutout formed entirely within said rectangular blank, said cutout including a second cutline generally parallel to said one cutline and spaced therefrom in a base panel in the other panel group corresponding to the base panel having the wedge formation projecting therefrom, a third cutline extending between the first and second cutlines and generally coextensive with one of said traverse fold lines;

C. said cutout extending into an adjacent pair of corresponding base panels in said panel groups and comprises a fourth cutline extending from the second cutline through one of said adjacent pair of corresponding base panels, and a fifth cutline extending from adjacent said wedge information through the other of said adjacent pair of corresponding base panels, said fourth and fifth cutlines converging within said adjacent pair of corresponding base panels.

8. The blank of claim 7 including a further pair of corresponding base panels, said further pair of corresponding base panels comprising the endmost panels of said panel groups at one end thereof, and a second cutout separating the base panels of said further pair of corresponding base panels.

9. The blank of claim 8 wherein said second cutout is of a width at least equal to the height of the base panels of said further pair of corresponding base panels.

* * * * *